US011686103B2

(12) United States Patent
Lehmann

(10) Patent No.: US 11,686,103 B2
(45) **Date of Patent: *Jun. 27, 2023**

(54) COUPLING SYSTEM FOR MOUNTING TILES TO A BUILDING

(71) Applicant: Hunter Douglas Inc., Pearl River, NY (US)

(72) Inventor: Christian Lehmann, Marblehead, MA (US)

(73) Assignee: HUNTER DOUGLAS INC., Pearl River, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/677,705

(22) Filed: Feb. 22, 2022

(65) Prior Publication Data

US 2022/0170274 A1 Jun. 2, 2022

Related U.S. Application Data

(63) Continuation of application No. 17/110,425, filed on Dec. 3, 2020, now Pat. No. 11,286,675, which is a continuation of application No. 16/669,620, filed on Oct. 31, 2019, now Pat. No. 10,900,238.

(60) Provisional application No. 62/883,156, filed on Aug. 6, 2019, provisional application No. 62/755,909, filed on Nov. 5, 2018.

(51) Int. Cl.
*E04F 13/08* (2006.01)

(52) U.S. Cl.
CPC ..... *E04F 13/0814* (2013.01); *E04F 13/0846* (2013.01)

(58) Field of Classification Search
CPC ..... E04F 13/0814; E04F 13/0846
See application file for complete search history.

(56) References Cited

U.S. PATENT DOCUMENTS

| | | | |
|---|---|---|---|
| 3,903,671 | A | 9/1975 | Cuin et al. |
| 4,028,859 | A | 6/1977 | Bellagamba |
| 5,138,809 | A | 8/1992 | Saikachi |
| 7,010,894 | B1 | 3/2006 | Cappelle |
| 2017/0342723 | A1 | 11/2017 | Krause |

FOREIGN PATENT DOCUMENTS

| | | | |
|---|---|---|---|
| WO | 2004079127 | A1 | 9/2004 |
| WO | 2010052921 | A1 | 5/2010 |

*Primary Examiner* — Patrick J Maestri

(57) ABSTRACT

A coupling system for mounting a tile to a framework of a building is disclosed. In one example of an embodiment, the coupling system includes a support bar arranged and configured for coupling to the tile and one or more clips coupled to the support bar. In one example of an embodiment, the clips include a tile-mounting opening for coupling the clips to the support bar and a frame-mounting opening for coupling the clips to the framework of the building to thereby couple the tile to the framework of the building. In one example of an embodiment, the support bar is arranged and configured for receipt within a longitudinal channel formed in the tile.

32 Claims, 14 Drawing Sheets

COUPLING SYSTEM FOR MOUNTING TILES TO A BUILDING

CROSS-REFERENCE TO RELATED APPLICATIONS

This is a continuation application of U.S. patent application Ser. No. 17/110,425, filed Dec. 3, 2020, entitled "Coupling System for Mounting Tiles to a Building," which is a continuation application of U.S. patent application Ser. No. 16/669,620, filed Oct. 31, 2019, now U.S. Pat. No. 10,900,238, entitled "Coupling System for Mounting Tiles to a Building," which is a non-provisional of, and claims the benefit of the filing date of, U.S. provisional patent application No. 62/755,909, filed Nov. 5, 2018, entitled "Coupling System for Mounting Tiles to a Building," and is a non-provisional of, and claims the benefit of the filing date of, U.S. provisional patent application No. 62/883,156, filed Aug. 6, 2019, entitled "Coupling System for Mounting Tiles to a Building," the entirety of each application is incorporated by reference herein.

FIELD OF THE DISCLOSURE

The present disclosure is directed to a coupling system for mounting a tile or façade or other functional or aesthetic structure to a building.

BACKGROUND

Generally speaking, exterior tiles may be coupled, mounted, attached, secured, or the like (used interchangeably herein without the intent to limit) to a building such as, for example, a framework of a building. For example, exterior facades, tiles, or other structural or decorative features, etc. such as, for example, ceramics, terracotta, or the like (collectively referred to herein as tiles without the intent to limit), may be coupled to the exterior framework of a building such as, for example, a high-rise building for any of a variety of architectural reasons. In use, the tile may have any size and/or shape, and may be manufactured from any type of material.

For example, referring to FIG. 1 and as will be appreciated by one of ordinary skill in the art, a building 10 such as, for example, a high-rise building, may include a support structure, column, or framework 20 (collectively herein framework without the intent to limit) for tiles 30. For example, as shown, the building 10 may include one or more vertical columns or frameworks 20. As illustrated, the vertical columns or frameworks 20 may be spaced apart from each other and separated by a structure 25 such as, for example, a window as illustrated (although it is envisioned that the separating structure may take on other forms such as, for example, a wall or the like). As will be appreciated by one of ordinary skill in the art, a tile 30 may be coupled to the building framework 20. For example, a tile 30 may be coupled to the building framework 20 for aesthetic reasons.

There are a number of known systems in the marketplace for coupling tiles to a building. Generally speaking, however, they could benefit from some improvements. One known concern with existing coupling systems is that, during use, the tile may become damaged. For example, during installation or post-installation during, for example, window cleaning, the tile may become cracked, resulting in an unsafe condition. Additionally, replacement of the damaged tile may be labor intensive and time-consuming.

There is a need for an improved coupling system for mounting exterior tiles to a building. For example, it would be beneficial to provide a coupling system that facilitates easier assembly. Additionally, and/or alternatively, it would be beneficial to provide a coupling system that minimizes the risk that a tile may fall from the building even when cracked. Additionally, and/or alternatively, it would be beneficial to provide a coupling system that facilitates easier removal and reinstallation of the tiles. Additionally, and/or alternatively, it would be beneficial to provide a coupling system that facilitates easier and individual replacement of each tile. It is with this in mind that the present disclosure is provided.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

Disclosed herein is a coupling system for coupling, mounting, attaching, securing, or the like (used interchangeably herein without the intent to limit) a tile such as, for example, an exterior tile, to a building such as, for example, a framework of a building. The coupling system includes one or more coupling mechanisms (e.g., one or more clips) for coupling tiles to the framework of the building.

In addition, and/or alternatively, in one example of an embodiment, the coupling system includes one or more support bars for supporting the tiles. In one embodiment, each support bar is arranged and configured to be coupled to a tile. For example, in one example of an embodiment, the support bar may be arranged and configured to be received within a longitudinal opening or channel formed in a tile.

In one example of an embodiment utilizing both support bars and coupling mechanisms, the coupling mechanism includes first and second clips, one at each end of the support bar, for coupling the support bar to the building framework. For example, in one example of an embodiment, the support bars include first and second ends. A first clip may be coupled to the first end of the support bar and a second clip may be coupled to the second end of the support bar. Thus arranged, in use, one or more support bars may be coupled to or operatively associated with the tile, and first and second clips may be coupled to opposite ends of the support bar for coupling the support bar and the tile to the building framework.

In one example of an embodiment, the clips include a tile-mounting opening, hole, etc. (used interchangeably without the intent to limit) for coupling the clip to the support bar via, for example, a fastener passing through the tile-mounting opening formed in the clip and through corresponding openings formed in the tile and the support bar. In addition, the clip may include a frame-mounting opening for coupling the clip to the framework of the building via, for example, a fastener passing through the frame-mounting opening formed in the clip and a corresponding opening formed in the framework of the building. Thus arranged, the clips may be fastened to the framework of the building and to the support bar, which is positioned within a channel formed in the tile. As such, the clips are arranged and configured to couple the tile and the support bar to the framework of the building.

DETAILED DESCRIPTION

Figure 1:
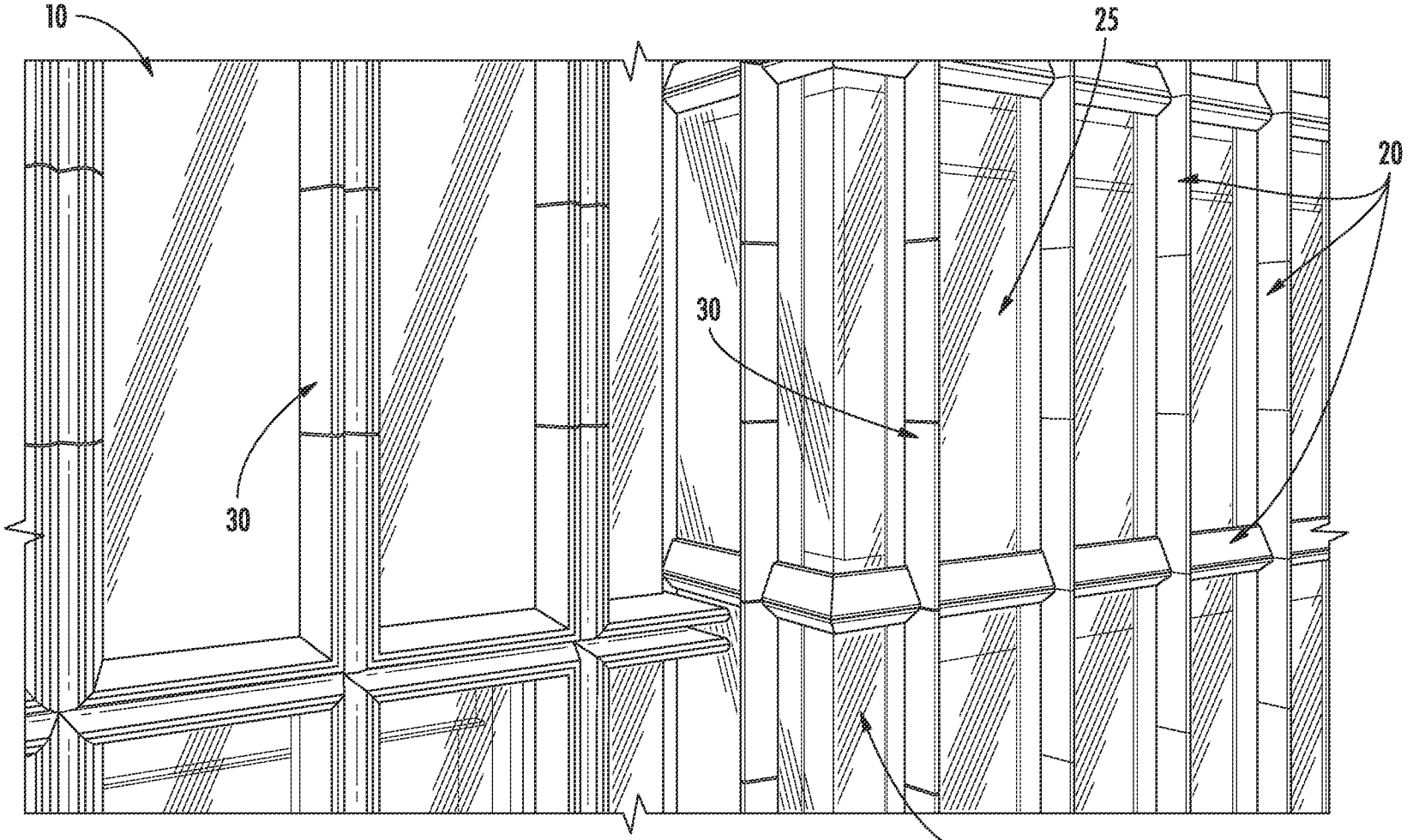
FIG. 1 (PRIOR ART)
FIG. 1 is a partial, perspective view illustrating an example of a building.

Various features, aspects, or the like of a coupling system for coupling, mounting, attaching, securing, or the like (used interchangeably herein without the intent to limit) a tile such as, for example, an exterior tile, to a building will now be described more fully hereinafter with reference to the accompanying drawings, in which one or more aspects of the coupling system will be shown and described. It should be appreciated that the various features, aspects, or the like may be used independently of, or in combination, with one another. It will be appreciated that a coupling system as disclosed herein may be embodied in many different forms and should not be construed as being limited to the embodiments set forth herein. Rather, these embodiments are provided so that this disclosure will convey certain aspects of the coupling system to those skilled in the art. In the drawings, like numbers refer to like elements throughout unless otherwise noted.

Figure 2:
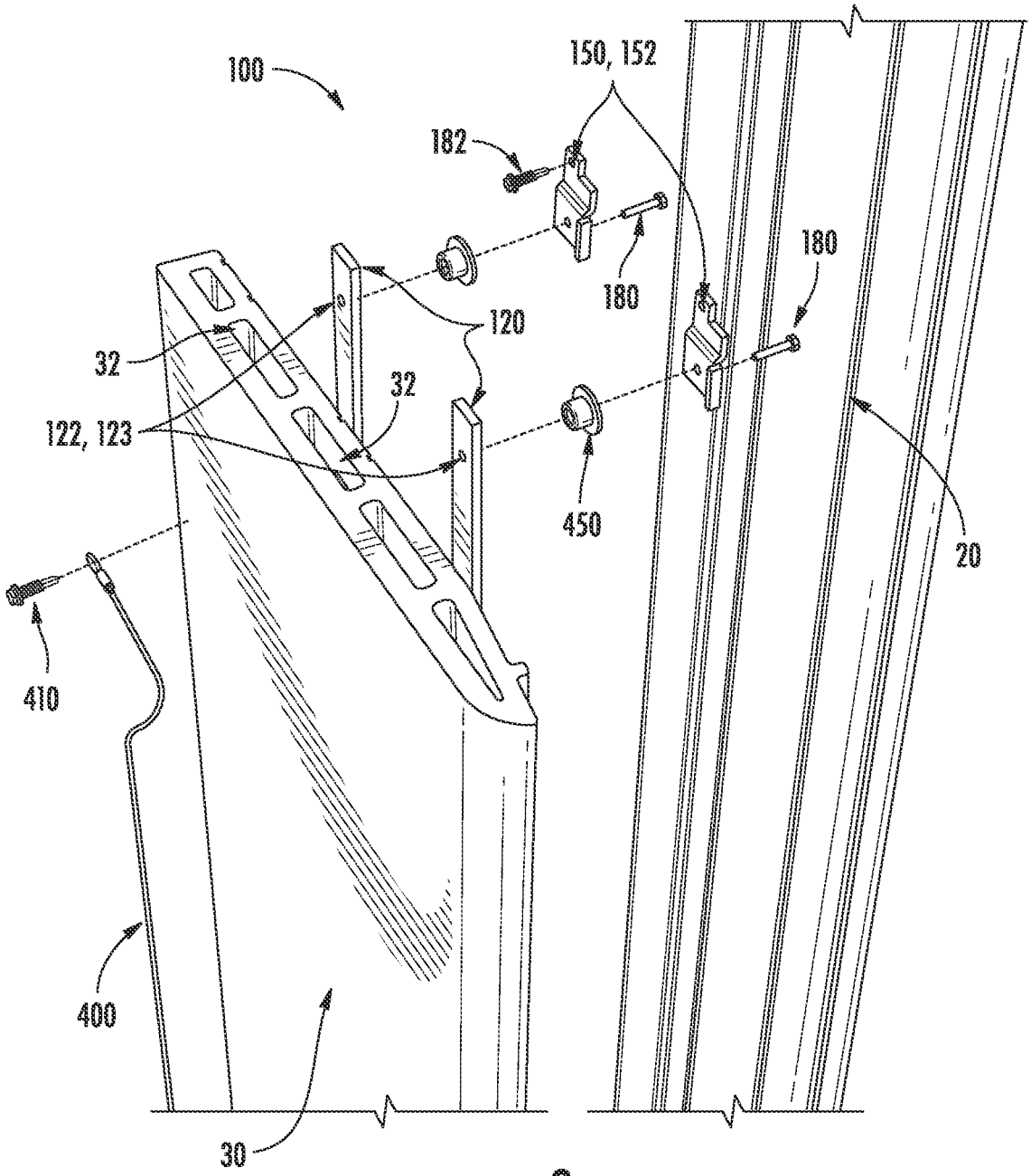
FIG. 2 is an exploded, perspective view of an example of an embodiment of a coupling system for coupling a plurality of tiles to a framework of a building embodying one or more aspects of the present disclosure.
Figure 3:
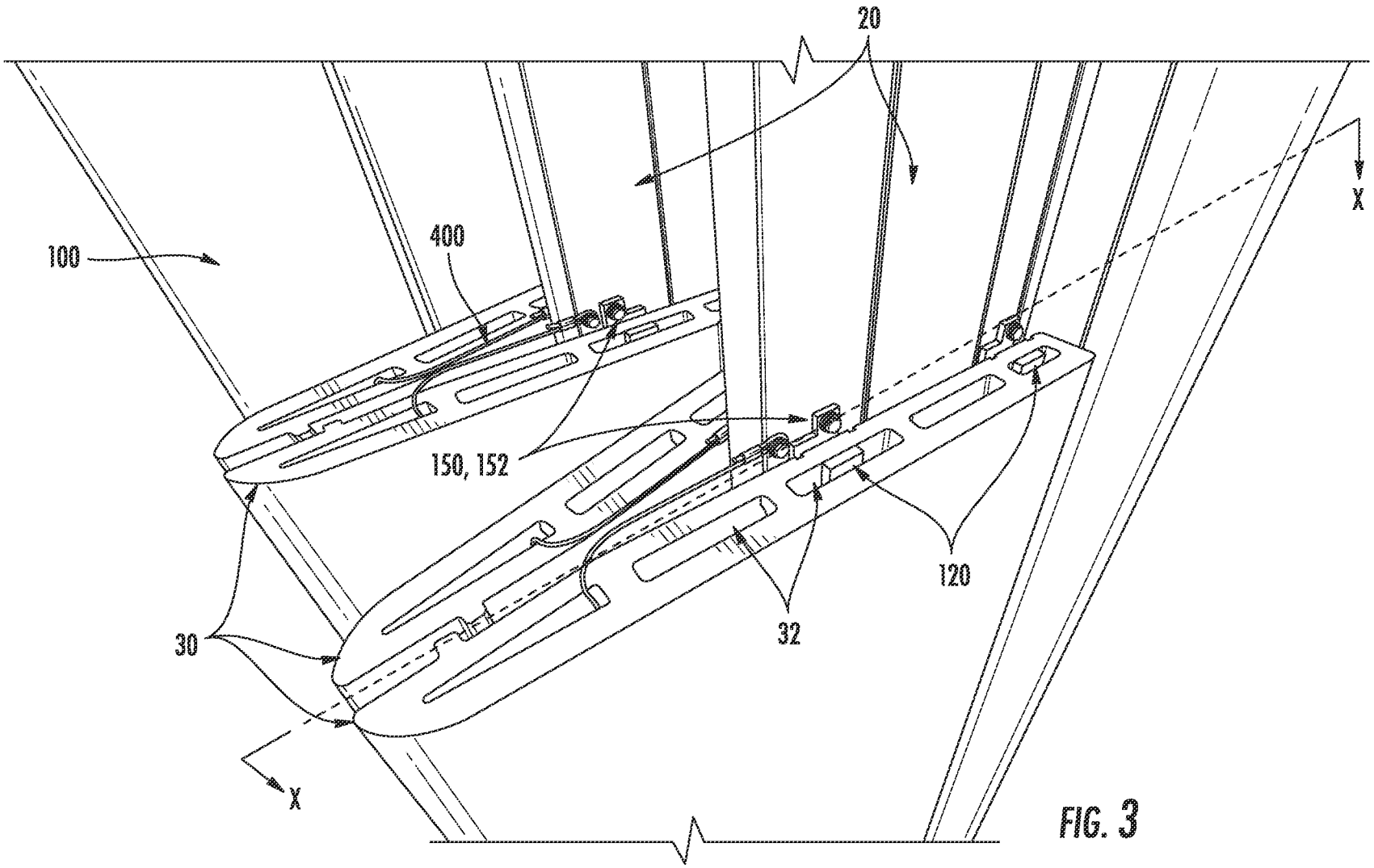
FIG. 3 is a partial, perspective view of the coupling system shown in FIG. 2.

Referring to FIGS. 2 and 3, in accordance with one aspect of the present disclosure, an improved coupling system 100 for mounting a tile 30 to the framework 20 of a building is disclosed. In one example of an embodiment, the coupling system 100 for coupling the tile 30 to the framework 20 of the building includes one or more coupling mechanisms 150 (e.g., one or more clips) for coupling the tile 30 to the framework 20 of the building. In addition, and/or alternatively, the coupling system 100 for coupling the tile 30 to the framework 20 of the building may include one or more support bars 120 for supporting the tile 30. In one example of an embodiment utilizing one or more support bars 120 and one or more coupling mechanisms 150 (e.g., one or more clips), the coupling mechanisms 150 may couple the tile 30 and the support bar 120 to the framework 20 of the building.

As will be described in greater detail below, and as previously mentioned, the coupling system 100 includes one or more coupling mechanisms 150 for coupling the tile 30 to the building framework 20. The coupling mechanism 150 may be provided in any suitable configuration for coupling the tile 30 to the building framework 20. For example, the coupling mechanism 150 may be in the form of one or more brackets (e.g., angled brackets, T-shaped brackets, etc.), one or more clevis, clamping the support bars with steel springs, PVC spacers, or the like, etc. Referring to FIG. 2, in one example of an embodiment, the coupling mechanisms 150 may be in the form of clips 152. The clips 152 may be provided in any shape or configuration to couple the tile 30 and the building framework 20. That is, the clips 152 may be any suitable clip now known or hereafter developed for coupling the tile 30 to the framework 20 of the building.

In addition, and/or alternatively, as previously mentioned, the coupling system 100 may include one or more support bars 120. The support bars 120 may be any now known or hereafter developed support bars or structural member suitable to support a tile 30 and maintain the tile 30 mounted on the building framework 20. For example, as illustrated, in one example of an embodiment, the support bar 120 may be in the form of a flat bar. However, the support bar 120 may have any suitable shape and/or configuration such as, for example, cylindrical, circular, tubular shaped, or the like. In use, each support bar 120 is arranged and configured to be coupled to a tile 30. For example, in one example of an embodiment, as illustrated, the tiles 30 may include a longitudinal opening or channel 32 formed therein. In use, the support bar 120 may be arranged and configured to be received, positioned, or the like, within the longitudinal opening or channel 32 formed in the tile 30, although other manners of coupling the support bar 120 to the tile 30 are envisioned. For example, the support bar 120 could be embedded within the tile 30, the support bar 120 could be adhered to the tile 30, the support bar 120 could be fastened to the tile 30, the support bar 120 could be clamped using, for example, steel springs, PVC spacers, or the like, etc.

In one example of an embodiment utilizing one or more coupling mechanisms 150 and one or more support bars 120, the one or more coupling mechanisms 150 may also be arranged and configured to couple the support bars 120 to the building framework 20. That is, in one example of an embodiment, the coupling mechanisms 150 are arranged and configured to couple the tile 30 and the support bars 120 to the building framework 20. For example, the coupling mechanism 150 may be arranged and configured to couple the support bar 120 to the building framework 20 and to provide additional fixation of the tile 30 to the support bar 120.

In the illustrated embodiment, each support bar 120 may include first and second clips 152, one at each end of the support bar 120. Thus arranged, in one example of an embodiment, one or more support bars 120 may be coupled to or operatively associated with the tile 30, and first and second clips 152 may be coupled to opposite ends of the support bar 120 for coupling the support bar 120 and the tile 30 to the building framework 20. For example, in one example of an embodiment, the support bars 120 include first and second ends. A first clip 152 may be coupled to the first end of the support bar 120, and a second clip 152 may be coupled to the second end of the support bar 120.

Figure 4:
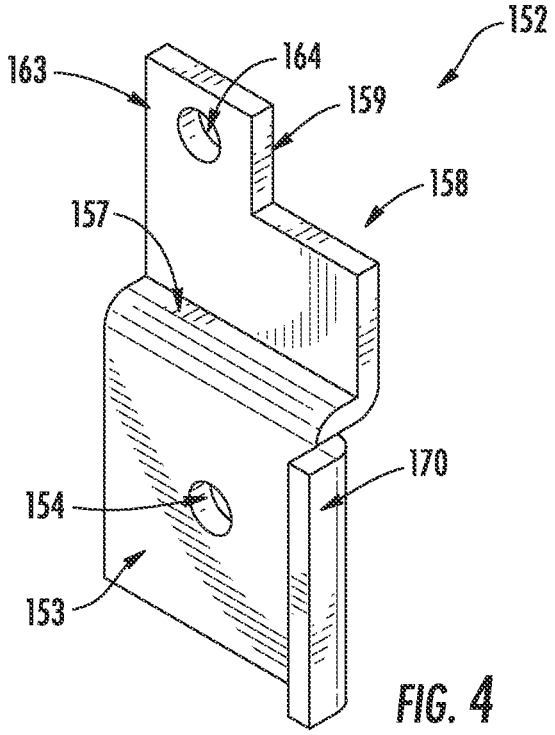
FIG. 4 is a perspective view of an example of an embodiment of a clip that may be used in the coupling system shown in FIG. 2.
Figure 5:
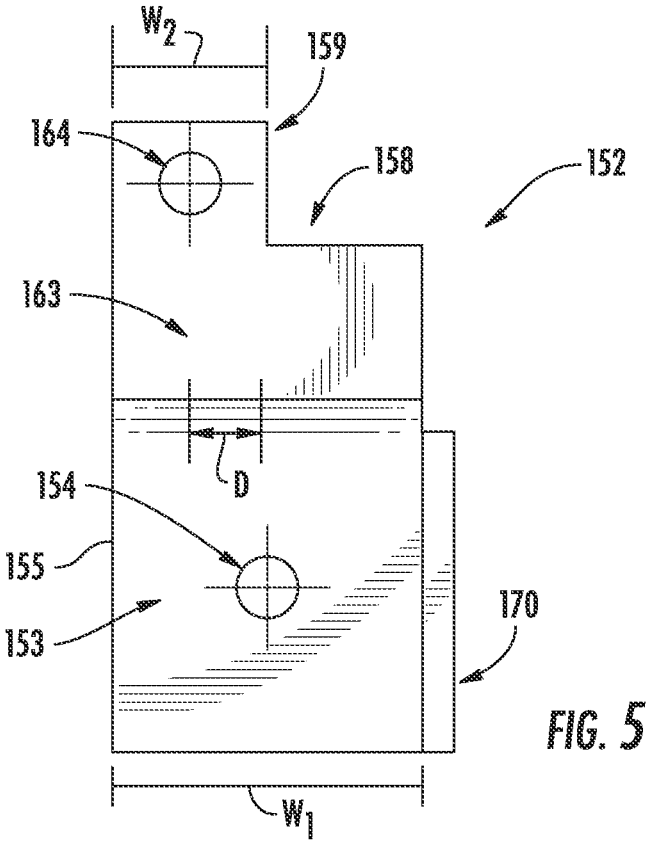
FIG. 5 is a front view of the clip shown in FIG. 4.

The clips 152 may be coupled to the building framework 20 and/or to the tile 30, and optionally to the support bar 120, by any suitable mechanism now known or hereafter developed. In one example of an embodiment, one or more fasteners, bolts, threaded screws, etc. 180 (used interchangeably herein without the intent to limit) (FIG. 2) may be used to couple the clips 152 to the tile 30 and optionally to the support bar 120 as well. In addition, one or more fasteners 182 may be used to couple the clips 152 to the building framework 20. Referring to FIGS. 4 and 5, in one example of an embodiment, the clips 152 may include a tile-mounting opening, hole, etc. 154 (used interchangeably without the intent to limit) for coupling the clip 152 to the tile 30, and optionally to the support bar 120, via, for example, a fastener 180 (FIG. 2) passing through the tile-mounting opening 154 formed in the clip 152. In addition, the clip 152 may include a frame-mounting opening 164 for coupling the clip 152 to the framework 20 of the building via, for example, a fastener 182 passing through the frame-mounting opening 164 formed in the clip 152. Thus arranged, in one example of an embodiment utilizing both clips 152 and support bars 120, the clips 152 may be fastened to the framework 20 of the building and to the support bar 120, which may be positioned within a channel 32 formed in the tile 30. As such, the clips 152 are arranged and configured to couple the tile 30 and the support bar 120 to the framework 20 of the building.

Figure 6:
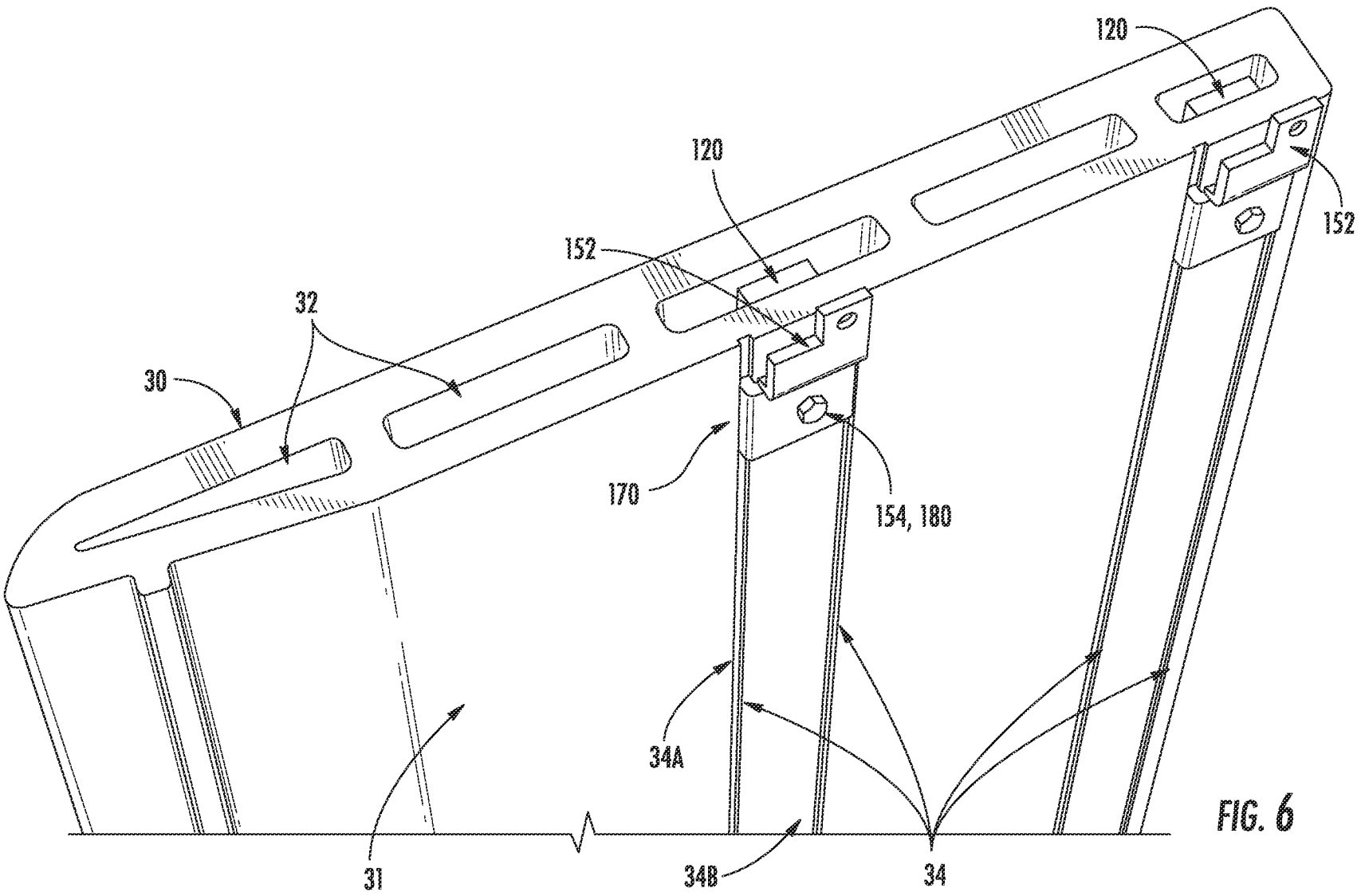
FIG. 6 is a partial, perspective view of the clip shown in FIGS. 4 and 5 coupled to a tile in accordance with one aspect of the present disclosure.
Figure 7:
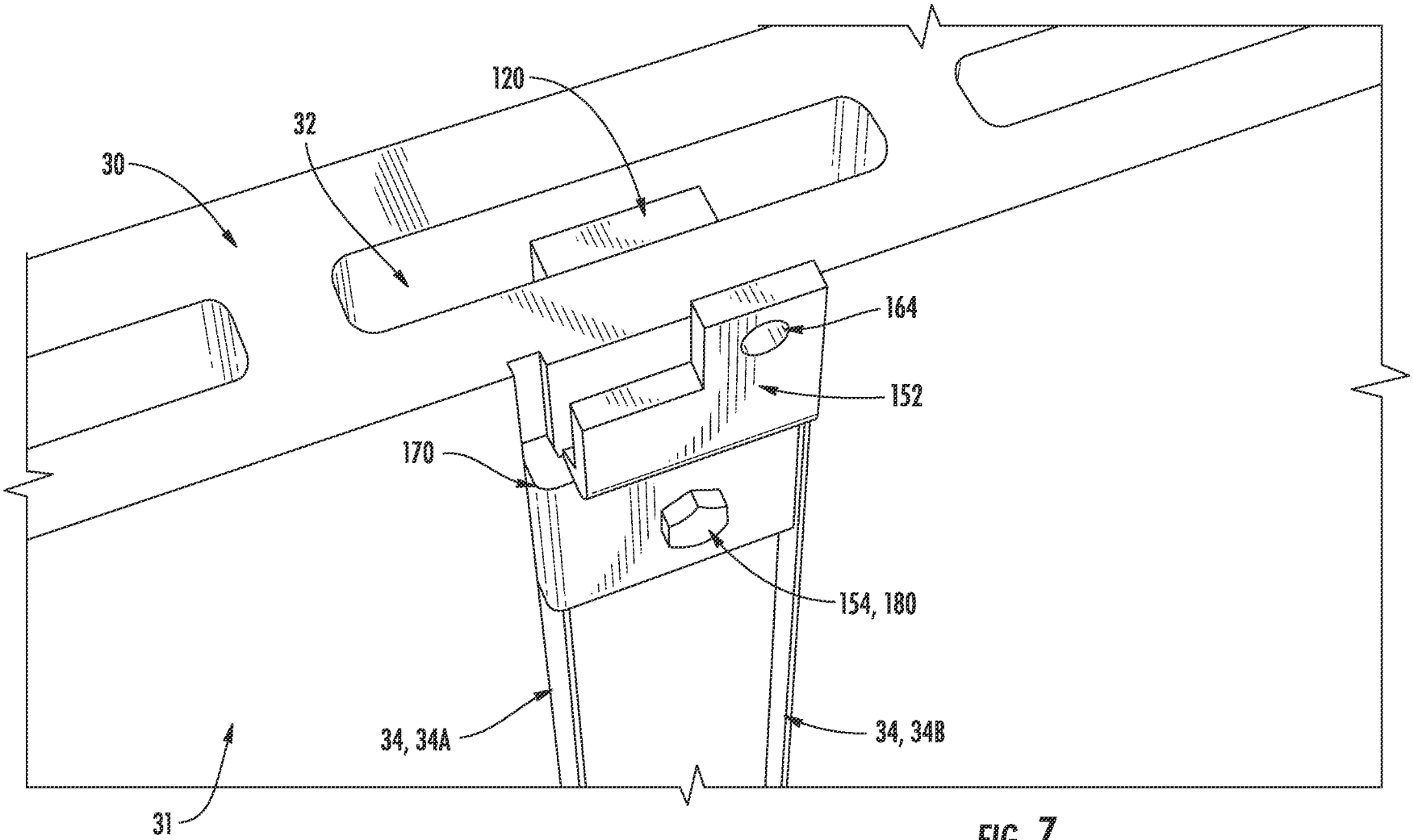
FIG. 7 is a partial, detailed perspective view of the clip shown in FIGS. 4 and 5 coupled to a tile in accordance with one aspect of the present disclosure.

Referring to FIGS. 6 and 7, in one example of an embodiment, in connection with, for example, the embodiment where the support bar 120 is positioned within a longitudinal channel 32 formed in the tile 30, the tile 30 may include first and second openings (not shown) formed therein. The support bars 120 may include first and second openings 123 (FIG. 2) formed in the first and second ends 122 (FIG. 2) of the support bar 120, respectively. In use, the tile-mounting opening 154 of the first clip 152 is configured to be aligned with the first opening formed in the tile 30 to enable a first fastener 180 to couple the first clip 152 to the first end 122 of the support bar 120. The tile-mounting opening 154 of the second clip 152 is configured to be aligned with the second opening formed in the tile 30 to enable a second fastener 180 to couple the second clip 152 to the second end (not shown) of the support bar 120.

Referring to FIGS. 2, 3, 6, and 7, as previously mentioned, first and second support bars 120 may be positioned within first and second channels 32, respectively, formed in the tile 30. In use, the support bars 120 may extend the full, longitudinal length of the tile 30. By positioning the support bars 120 within channels 32 formed in the tile 30 and subsequently coupling the support bars 120 to the tile 30 and/or clips 152 on opposite ends thereof, the support bars 120 are better able to secure the position of the tile 30 even if the tile 30 should become damaged or cracked. It should be understood that while first and second bars 120 are illustrated and described, it is envisioned that fewer or greater numbers of bars 120 may be used. For example, it is envisioned that a single support bar 120 per tile 30 may be used. Alternatively, it is envisioned that three, four, or more support bars 120 may be used per tile 30. Additionally, and/or alternatively, while the support bars 120 are illustrated as being flat bars, it is envisioned that the support bars may have any other suitable shape including, for example, round, box-shaped, C-channel, or the like.

Referring to FIGS. 4 and 5, an example of an embodiment of a clip 152 in accordance with one aspect of the present disclosure is illustrated. As illustrated, the clip 152 includes a body portion 153 having, for example, the tile-mounting opening 154 for receiving and enabling a fastener 180 to pass therethrough for coupling the clip 152 to the tile 30 and/or support bar 120, and a frame-coupling section 163 having, for example, the frame-mounting opening 164 for receiving and enabling a fastener 182 to pass therethrough for coupling the clip 152 to the building framework 20. In use, the fasteners 180, 182 can be any now known or hereafter developed for use in such context, such as a screw, and providing sufficient strength. It will be appreciated that in any embodiment in accordance with this disclosure, the specific configuration for mounting (e.g., the above-described opening and fastener therethrough) is not critical, and other configurations of the clip 152 to facilitate coupling to the support bar 120, tile 30, and/or the building framework 20 may be used in combination with other clip features or structures disclosed herein.

In one example of an embodiment, the clip 152 may also include one or more stabilizing features or elements arranged and configured to interact with the tile 30 to prevent relative twisting and/or rotation of the clip 152 relative to the tile 30 (e.g., clips 152 are arranged and configured to inhibit and preferably to prevent relative rotation between the clips 152 and the tile 30). In use, the stabilizing or anti-rotation (such terms may be used interchangeably without intent to limit) feature may be provided in any form that prevents relative rotation between the clips 152 and the tile 30 such as, for example, by engaging the clips 152 and tiles 30 with each other (coupling the clip and tile together, or at least blocking movement of one relative to the other).

Referring to FIGS. 4-7, in one example of an embodiment, the clips 152 may include a projection 170 extending therefrom (e.g., an anti-rotational or stabilizing projection to prevent relative rotation between the clips 152 and the tile 30). The projection 170 may be arranged and configured to be received within a groove 34 (FIGS. 6 and 7) such as, for example, a longitudinal groove 34, formed in an inner surface 31 of the tile 30 to prevent movement of the clip 152 such as, for example, preventing relative twisting and/or rotation of the clip 152 relative to the tile 30 during, for example, assembly, transportation, installation, etc. That is, in use, the interaction between the projection 170 formed on the clip 152 and the groove 34 formed in the tile 30 prevents relative movement between the clip 152 and the tile 30. In addition, the interaction between the projection 170 formed on the clip 152 and the groove 34 formed in the tile 30 facilitates alignment of the clip 152 relative to the tile 30. In use, the clip 152 is coupled to the tile 30 via, for example, a fastener 180 passing through the tile-mounting opening 154. In one example embodiment, the groove 34 formed in the tile 30 may be formed by, for example, an extrusion, although it is envisioned that the groove 34 may be formed by any now known or hereafter developed process.

As illustrated, in one example of an embodiment, the projection 170 may be integrally formed. For example, the projection 170 may be formed along an edge of the clip 152 such as, for example, an edge of the body portion 153. In this manner, the projection 170 may be manufactured by bending an edge portion of the body portion 153 of the clip 152. However, it is envisioned that the clip 152 and/or projection 170 may take other forms. For example, it is envisioned that the projection 170 may be coupled to the clip 152 at a position inwardly of the edge portion of the body portion 153. Moreover, the projection 170 may be separately formed and coupled to the clip 152. Additionally, while the clip 152 has been illustrated and described as including a single projection, it is envisioned that each clip 152 may include two or more projections 170. Alternatively, it is envisioned that the tile 30 may include one or more projections and the clips 152 may include one or more grooves. Alternatively, in one example embodiment, it is envisioned that the tile 30 may include one or more recesses for receiving at least a portion of the clips 152, such as, for example, the body portion 153 of the clip 152, to prevent relative rotation and/or twisting of the clip 152 relative to the tile 30. As previously mentioned, the stabilizing feature may take any form for preventing relative rotation between the clips 152 and the tile 30.

Referring to FIGS. 4 and 5, in one example of an embodiment, the clip 152 may be arranged and configured so that the frame-coupling section 163 lies in a plane that is parallel to, but spaced apart from, a plane of the body portion 153. For example, as illustrated, the body portion 153 may include a bend 157 formed therein. In this manner, the body portion 153 is better able to lie adjacent to the inner surface 31 of the tile 30 and the frame-coupling section 163 is better able to lie adjacent to the framework 20 of the building.

Figure 8:
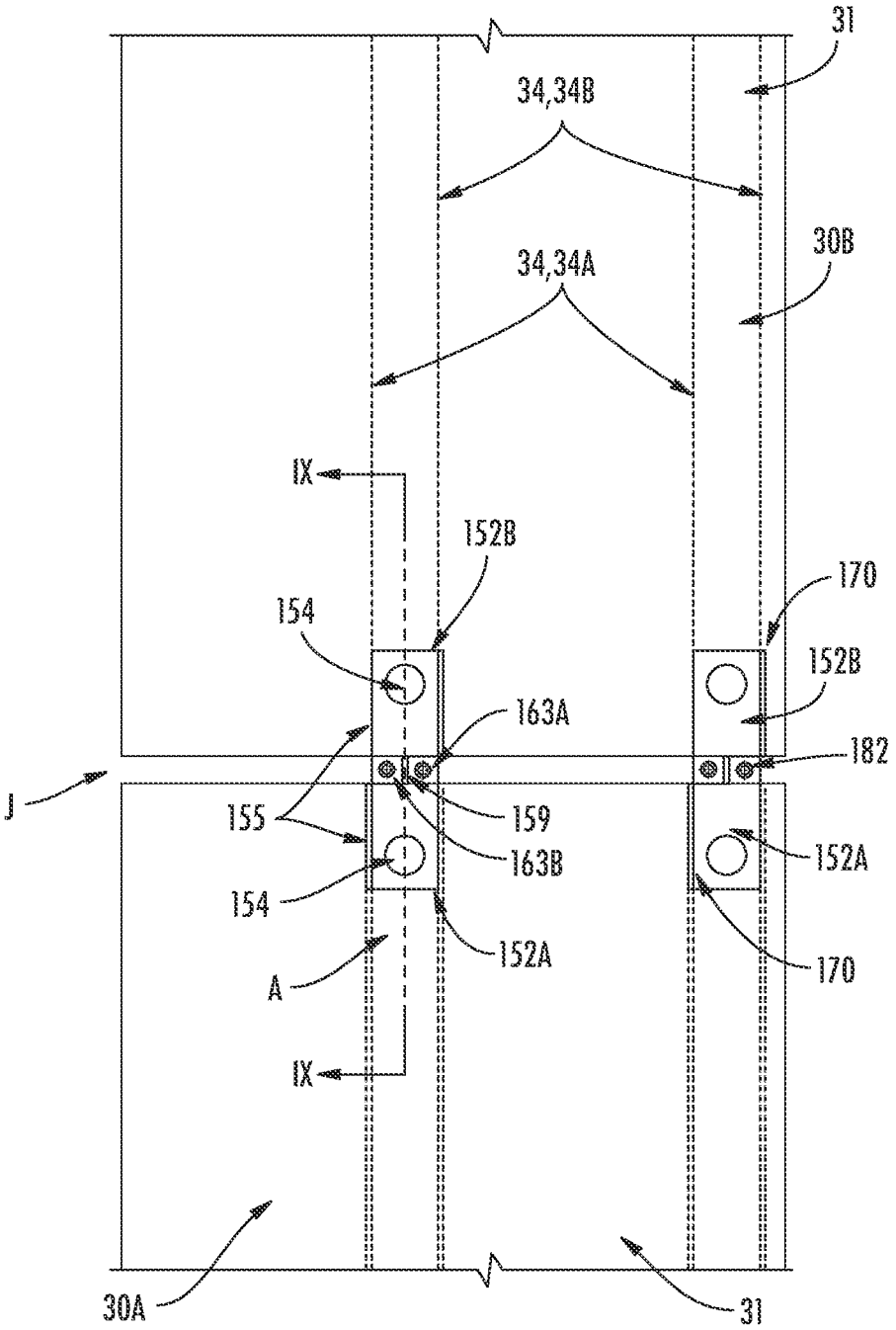
FIG. 8 is a partial, perspective view of the clips shown in FIGS. 4 and 5 coupled to first and second tiles in accordance with one aspect of the present disclosure.
Figure 9:
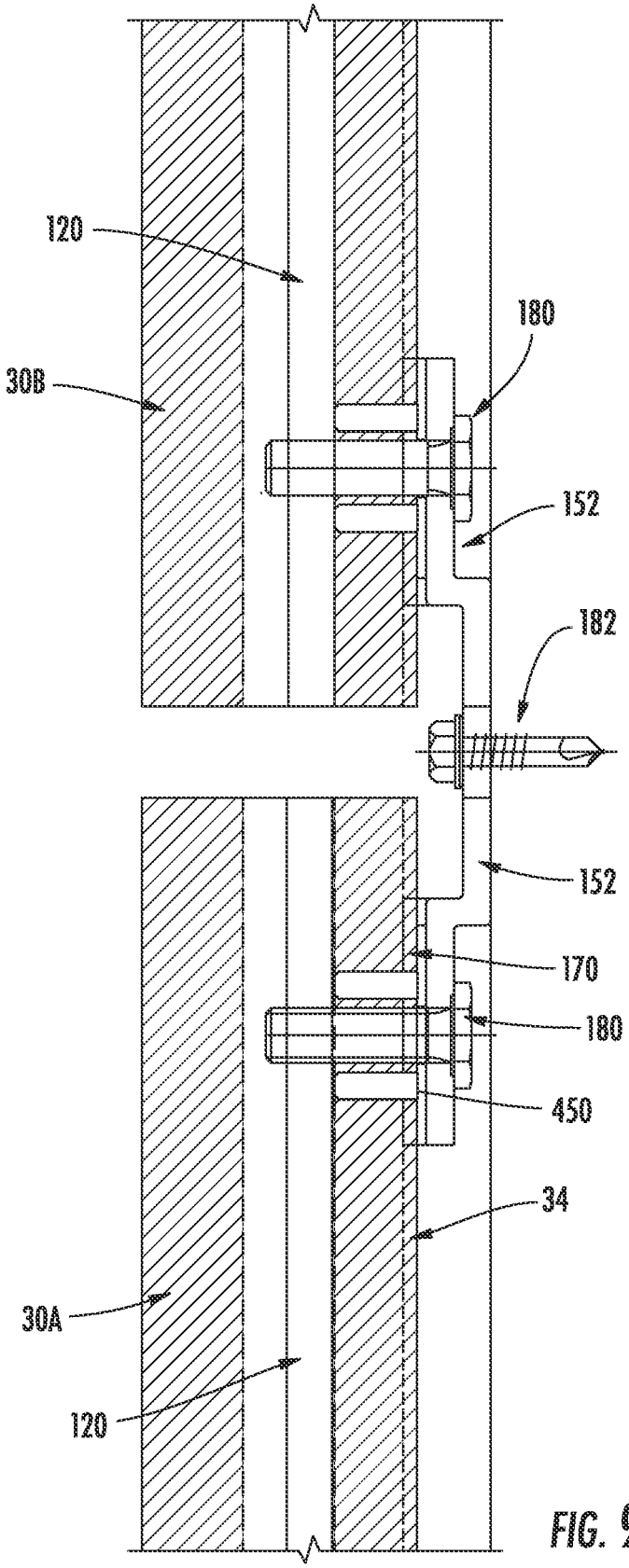
FIG. 9 is a partial, detailed, longitudinal cross-sectional view taken along line IX-IX in FIG. 8.
Figure 10:
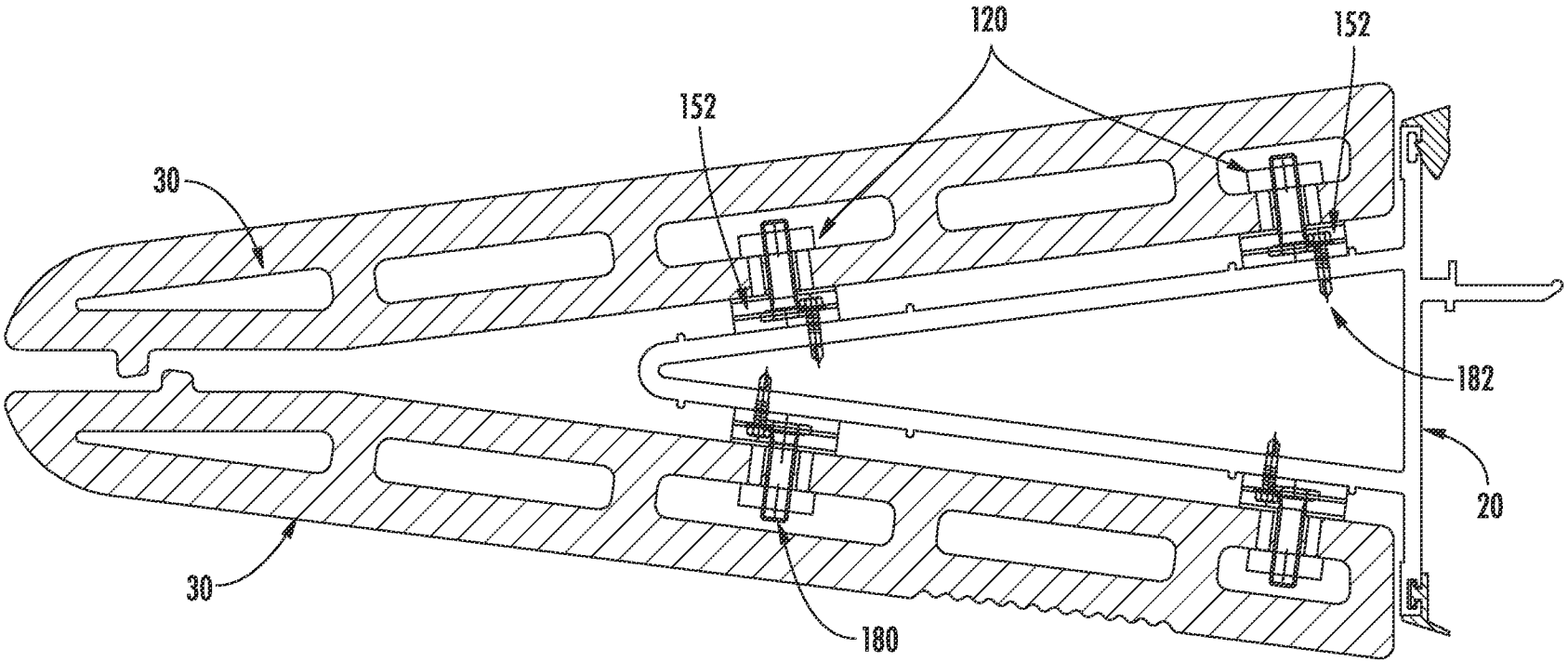
FIG. 10 is a horizontal cross-sectional view taken along line X-X in FIG. 3.
Figure 11:
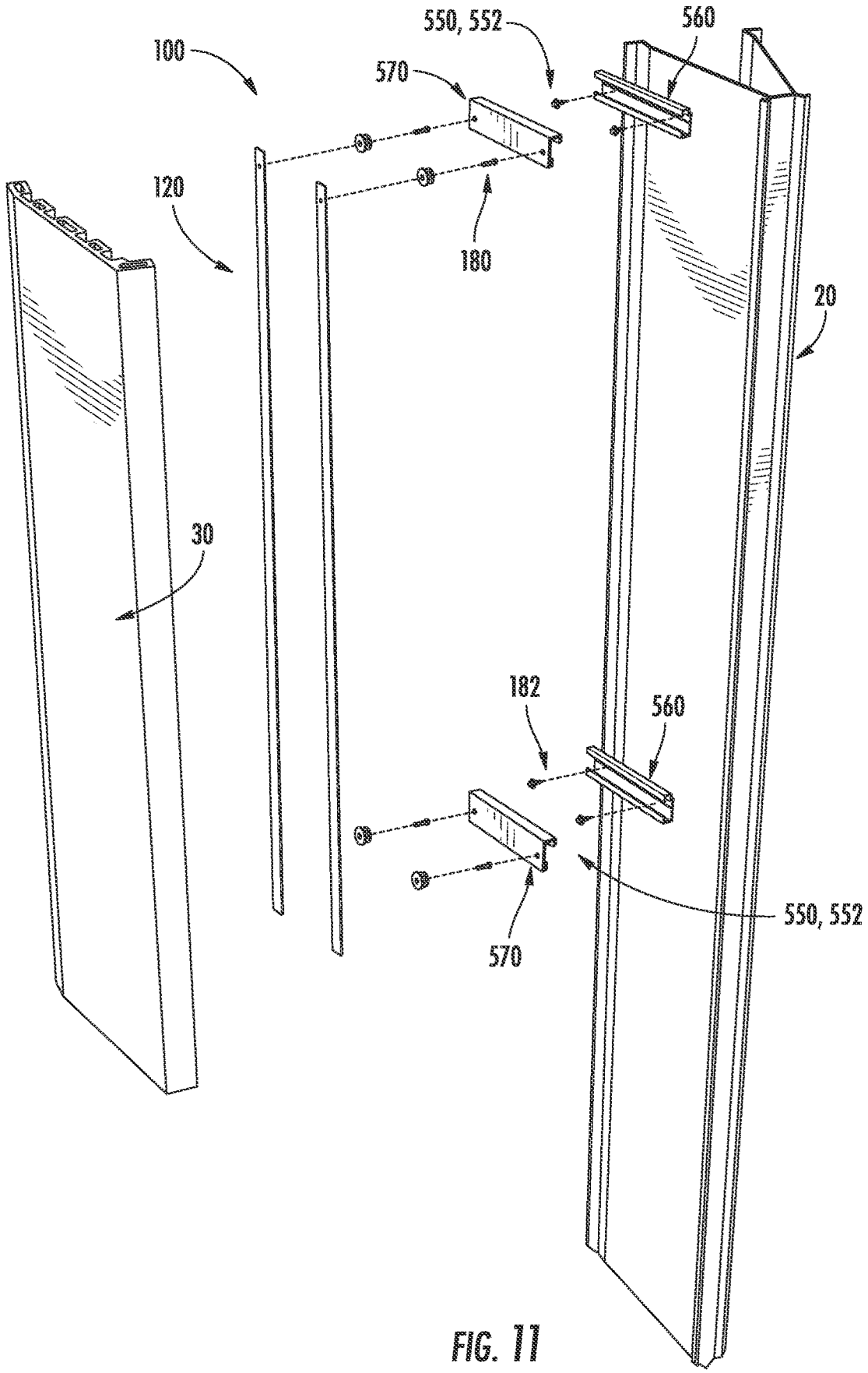
FIG. 11 is an exploded, perspective view of an example of an embodiment of a coupling system for coupling a plurality of tiles to a framework of a building embodying one or more aspects of the present disclosure.
Figure 12:
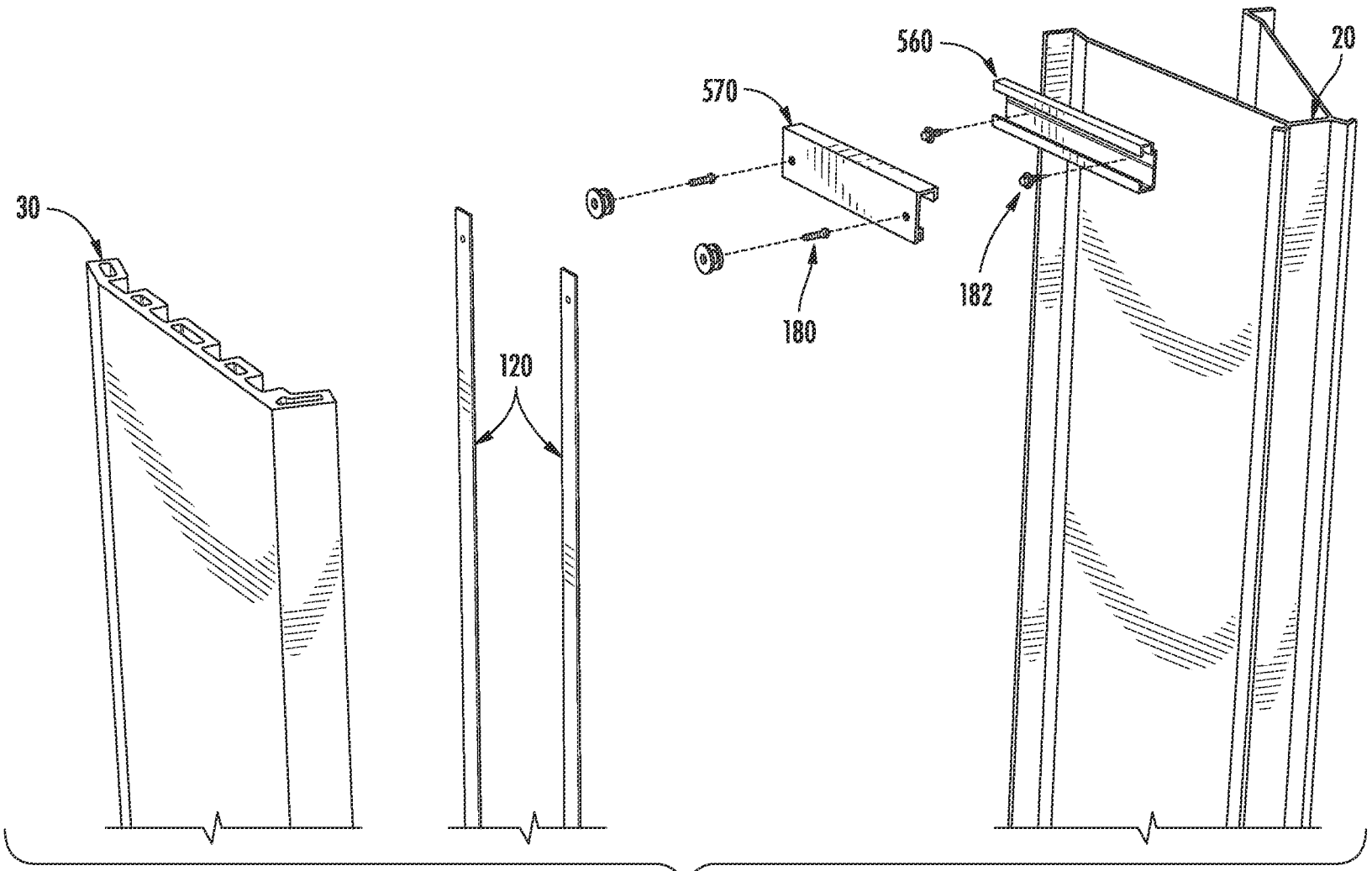
FIG. 12 is a partial, exploded perspective view of the coupling system shown in FIG. 11.
Figure 13:
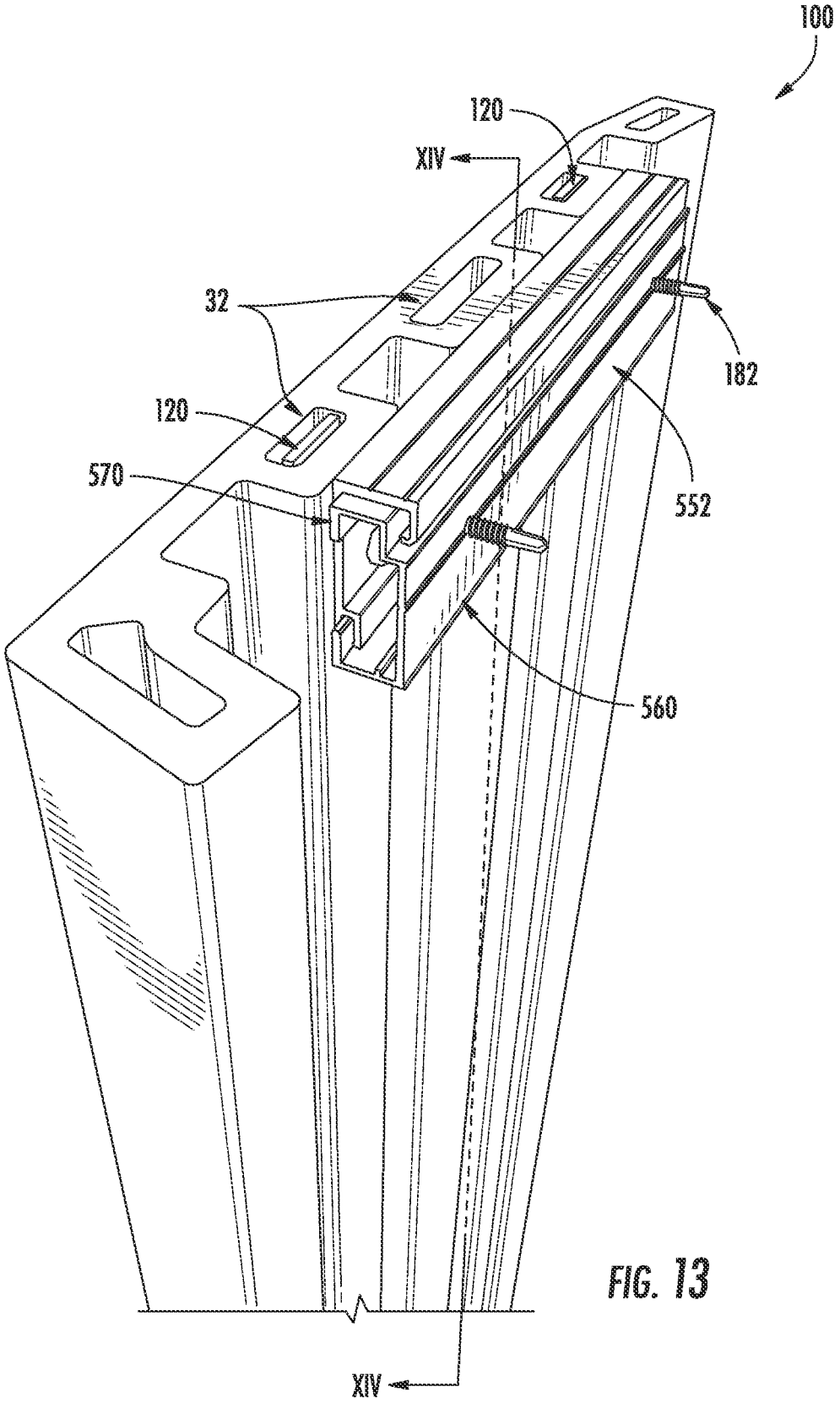
FIG. 13 is a perspective view of an example of an embodiment of a clip that may be used in the coupling system shown in FIG. 11, the clip shown coupled to a tile.

In accordance with another aspect of the present disclosure, referring to FIG. 8, the clips 152 may be arranged and configured so that adjacent clips 152 for mounting adjacent tiles 30 to the building framework 20 facilitate a tighter or smaller joint J between first and second adjacent tiles 30 and/or to prevent relative rotation between the clips 152 and the framework 20 of the building. For example, in one example of an embodiment, adjacent clips 152 (such as, for example, clips 152A, 152B) may be used to mount adjacent longitudinal tiles 30 (e.g., upper and lower tiles 30A, 30B) to the building framework 20 to facilitate a smaller gap or joint J between the upper and lower tiles 30A, 30A. The clips 152 may be configured so that coupling of adjacent tiles 30A, 30B to the building framework 20 via the adjacent clips 152A, 152B is substantially side-by-side, and, more particularly (in one example of an embodiment), the location of the coupling of each clip 152 to the building framework 20 is substantially equidistant from a given tile 30 to minimize the gap between the adjacent tiles 30 (e.g., each of the frame-mounting openings 164 formed in the clips 152 is substantially the same distance from a given tile 30 to minimize spacing between the tiles 30). By positioning the frame-coupling sections 163 in a side-by-side fashion, the fasteners 182 for coupling the clips 152A, 152B to the framework 20 of the building are also positioned in a side-by-side fashion, thus enabling the first and second tiles 30A, 30B to be positioned closer together resulting in a smaller horizontal gap or joint J between the first and second tiles 30A, 30B. That is, by positioning the frame-coupling sections 163 of adjacent clips 152A, 152B in a side-by-side orientation, the fasteners 182 for coupling the clips 152A, 152B to the building framework 20 may be placed closer together (e.g., fasteners 182 may be positioned in a side-by-side relationship), which enables the adjacent tiles 30A, 30B to be positioned closer to each other.

For example, in one example of an embodiment, as schematically illustrated in FIG. 8, a frame-coupling section 163A of a first clip 152A for coupling a first tile 30A to a building framework 20 may be arranged and configured to fit neatly (e.g., configured to be positionable, nest, mate, or the like) alongside a frame-coupling section 163B of a second clip 152B for coupling a second tile 30B to the building framework 20 adjacent the first tile 30A. That is, in use, the second clip 152B for coupling the second tile 30B may be positioned adjacent to a first clip 152A for coupling the first tile 30A to minimize the distance between the adjacent tiles 30A, 30B. For example, the second clip 152B for coupling the second tile 30B may be positioned horizontally with respect to, or transverse to the longitudinal extent of the first clip 152A. In one example of an embodiment in which the tiles 30A, 30B are positioned longitudinally in a vertical direction (one above the other), the second clip 152B for coupling to the upper or second tile 30B may be positioned adjacent to the first clip 152A for coupling to the lower or first tile 30A. In use, however, if the identical clip configuration is used on each adjacent tile, the second clip 152B for coupling the upper or second tile 30B is orientated or positioned 180 degrees relative to the first clip 152A for coupling the lower or first tile 30A such that the frame-coupling section 163B of the second clip 152B is positioned side by side with the frame-coupling section 163A of the first clip 152A, and vice-versa.

In one example of an embodiment, as illustrated in FIGS. 4 and 5, the frame-coupling section 163 includes a reduced width $W_2$ relative to a width $W_1$ of the body portion 153 so that a notch, a cutout, or open area 158 is formed. As such, the frame-coupling section 163 of the second clip 152B for coupling the upper or second tile 30B to the building frame 20 may reside in the notch, cutout, or open area 158 formed in the first clip 152A for coupling the lower or first tile 30A to the building frame 20. In this manner, the adjacent, side-by-side orientated clips 152A, 152B minimize the distance between the adjacent tiles 30A, 30B. In addition, the adjacent, side-by-side orientated clips 152A, 152B prevent relative rotation of the clips 152 to the building framework 20.

In one example of an embodiment, as schematically illustrated in FIG. 8, it is desirable for the tile-mounting openings 154 (the opening 154 in the body portion 153 of the clip 152 via which the clip 152 is coupled to the tile 30 and optionally to the support rod 120) of adjacent clips 152A, 152B of adjacent tiles 30A, 30B to be aligned along an axis A of alignment extending through the tiles 30A, 30B and/or the clips 152A, 152B (e.g., with the outer side edges 155 of the clips 152 substantially aligned and the tile-mounting openings aligned 154). That is, as illustrated in FIG. 8, the tile-mounting opening 154 formed in the first clip 152A is vertically aligned with the tile-mounting opening 154 formed in the second clip 152B. Such alignment is particularly desirable if a support bar 120 is used so that the tile-mounting openings 154 are aligned with the support bar 120 (as described in further detail below). In order to assure such alignment, the frame-coupling sections 163A, 163B of the adjacent clips 152A, 152B must be able to be placed side-by-side without causing the tile-mounting openings 154 to be misaligned. In particular, in one example of an embodiment, if the same clip 152 is used for each of the adjacent tiles 30A, 30B, the second clip 152B may be rotated 180 degrees relative to the first clip 152A, the inner side edge 159 of the frame-coupling section 163 (which will be adjacent to the corresponding inner side edge 159 of the adjacent clip) should not extend past the alignment axis A of the tile-mounting openings 154 (e.g., line passing through the centers of the tile-mounting openings 154, aligned with support bar 120 if present). If the inner side edges 159 extend past the alignment axis A of the tile-mounting openings 154, then the clips 152A, 152B cannot have their frame-coupling sections 163A, 163B side-by-side and also have their tile-mounting openings 154 aligned. If the inner side edges 159 do not extend past, and are not aligned with, the alignment axis A of the tile-mounting openings 154, then there will be a gap between the adjacent sides of the frame-mounting sections 163A, 163B of adjacent clips 152A, 152B on adjacent tiles 30A, 30B. Such widthwise gap is generally acceptable as it does not affect the reduced distance between the adjacent tiles achieved by having the framework-mounting openings side-by-side. As such, the frame-coupling sections 163 are generally narrower than the body portion 153 of the clips 152, and are configured to mate with or fit together with an adjacent identical clip rotated 180 degrees.

Referring to FIG. 5, in one example of an embodiment, the body portion 153 has a first width $W_1$ and the frame-coupling section 163 has a second width $W_2$, wherein width $W_2$ is less than width $W_1$. In one example embodiment, width $W_2$ is no more than half the width $W_1$ of the body portion 153. In one example of an embodiment, width $W_2$ is half the width $W_1$. For example, in one example of an embodiment, width $W_1$ may be 1 3/16 inch and width $W_2$ may be 9/16 inch, although these dimensions are exemplary and other sizes are envisioned.

In one example of an embodiment, by arranging and configuring the frame-coupling sections 163 to be no more than half the width of the body portion 153, adjacent inner side edges 159 of the clips 152 on adjacent tiles 30 (the inner side edges 159 of the clips 152 which are positioned adjacent each other), may not extend beyond the centerline of the tile-mounting openings 154. Thus arranged, the respective tile-mounting openings 154 on the adjacent clips 152 on the adjacent tiles are not shifted out of alignment.

Additionally, in use, as illustrated in FIG. 8, with the frame-coupling section 163 having a width $W_2$ that is no more than one-half the width $W_1$ of the body portion 153 (and preferably one-half the width $W_1$ of the body portion 153), the outer side edge 155 of the first and second adjacent clips 152A, 152B are substantially aligned with each other, thus providing a more compact design. Such alignment of the outer side edges 155 of the adjacent clips 152A, 152B allows for a projection 170 (or other anti-rotation feature) on each side edge 155 to engage a corresponding groove 34 (or other anti-rotation feature) extending along the tile 30.

That is, referring to FIGS. 6-8, the inner surface 31 of the tile 30 includes first and second grooves 34A, 34B for each clip 152. In use, the clips 152 are identical, however, the clips 152A, 152B are rotated 180 degrees. As such, in use, with the tile-mounting openings 154 positioned symmetrically in between the first and second grooves 34A, 34B, the first groove 34A is arranged and configured to receive the projection 170 formed on the first clip 152A when the first clip 152A is orientated in a first or upwards position, the second groove 34B is arranged and configured to receive the projection 170 on the second clip 152B when the second clip 152B is orientated in a second or downwards position. That is, the inner surface 31 of the tile 30 may be formed with first and second spaced apart grooves 34A, 34B, the grooves 34A, 34B being spaced apart so that the first groove 34A is arranged and configured to receive the projection 170 on the clip 152 when the clip 152 is positioned in an upright position, the second grove 34B is arranged and configured to receive the projection 170 on the clip 152 when the clip 152 is positioned in a downwards orientated position.

In this manner, during assembly, the size (e.g., width) of the clip 152 and/or frame-coupling section 163 may be selected to correspond with the spacing of the grooves 34A, 34B formed in the tile 30. In this manner, the projection 170 formed on the clip 152 is arranged and configured to interact with one of the grooves 34A, 34B formed in the tile 30.

As may be appreciated, the alignment of the tile-mounting openings 154 of the clips 152 is particularly important if support bars 120 are used, as support bars 120 generally are straight/linear, and the openings in the tiles 30 through which fasteners 180 extend to couple the clips 152 to the support bars 120 must extend linearly and be aligned relative to one another along the tiles 30 (e.g., aligned vertically along the tiles 30). In use, the clips 152 may be coupled to a support bar 120 by any mechanism now known or hereafter developed. For example, as illustrated in FIG. 2, each support bar 120 may include an opening 123 such as, for example, a threaded opening for receiving a fastener 180 for coupling a clip 152 to the support bar 120. Each support bar 120 may include first and second openings (e.g., threaded openings) formed on opposite ends thereof for use in coupling first and second clips 152, respectively, to the support bar 120. After positioning a support bar 120 within a channel 32 formed in the tile 30, first and second openings, respectively, may be formed in the tile 30 so that the first and second fasteners 180 may extend through the tile 30 to couple the clip 152 to the support bar 120. As illustrated in FIG. 2, optional bushings 450 may be inserted into the openings formed in the tile 30 to protect the tile 30.

In this manner, in accordance with one or more aspects of the present disclosure, the support bars 120 and the clips 152 may be coupled to the tile 30 prior to installation. For example, the support bars 120 and the clips 152 may be coupled to the tile 30 prior to delivery to the worksite. The clips 152 may be arranged and configured so that, in use, the clips 152 can be initially coupled to the tile 30 to facilitate easier assembly and installation of the tile 30. For instance, a tile 30 carrying pre-mounted clips 152 which, as described herein, have been mounted to inhibit (and preferably prevent) rotation or other movement of the clips 152 relative to the tile 30 has been found to be easier to mount on a building framework 20 than prior art tiles. The tile and clip system may be further enhanced by the provision of support bars 120 within the tiles 30 (to provide support to the tile 30 in case of accidental damage to the tile 30), with the clips 152 fastened to the support bars 120 when mounted on the tiles 30. Thus, in essence, a subassembly including the tile 30, support bars 120, and clips 152 may be formed.

Thereafter, the subassembly may be positioned against the building framework 20, and coupled to the building framework 20 via fasteners 182 designed for coupling the clips 152 to the building framework 20. As such, easier installation is facilitated. In addition, by removing the fasteners 182 coupling the clips 152 to the building framework 20, easier replacement of the tiles 30 is achievable. That is, in accordance with one aspect of the present disclosure, since the support bars 120 are positioned within the longitudinal channels 32 formed in the tile 30 and the clips 152 are coupled to the support bars 120, removal of the clips 152 from the framework 20 of the building by, for example, removing the fasteners 182 used to couple the clips 152 to the framework 20, allows a user to remove the tile 30 including the support bar 120 and clips 152. The clips 152 may be arranged and configured so that, in use, the clips 152 can be readily accessible so that the clips 152, and hence the tile 30, can be readily disconnected from the building framework 20 to facilitate easier removal and replacement of the tiles 30, as required.

Moreover, the clips 152 enable easier removal and reinstallation without modifying the tiles 30 or the coupling system 100. This is in contrast with known prior art systems that require, for example, the formation of a notch in the tile, modification of the clips, or utilization of glue to remove and replace an existing tile. It will be appreciated that this concept is independent of the concept of anti-rotation or stabilizing features and these features may be used separately or in conjunction with each other.

Additionally, and/or alternatively, as described and illustrated herein, the clips 152 may be arranged and configured so that, in use, adjacent clips 152 for coupling adjacent tiles 30 on a building framework 20 may be positioned closer together (such as by virtue of a unique configuration of the clips) to provide a smaller gap between the adjacent tiles.

Referring to FIGS. 4 and 5, the centerline of the frame-mounting opening 164 formed in the frame-coupling section 163 may be spaced from the centerline of the tile-mounting opening 154 formed in the body portion 153 by a distance D (e.g., the centerline of the frame-mounting openings 164 and the tile-mounting openings 154 may be parallel but axially spaced relative to each other across the width of the clip 152). By arranging and configuring the off-set centerlines of the frame-mounting openings 164 and the tile-mounting openings 154 in the clip 152, when the frame-coupling sections 163 of the first and second clips 152A, 152B are positioned in a side-by-side complementary manner (as schematically illustrated in FIG. 8), each of the fasteners 182 for coupling the clips 152 to the framework 20 of the building are similarly arranged in a side-by-side fashion and thus can be easily and independently accessed and removed, as required. As such, the installer can independently access and remove each of the fasteners 182 for coupling the clip 152 to the framework 20 of the building. Thus, such arrangement and configuration facilitates replacement of individual tiles. For example, in one example of an embodiment, by removing each of the fasteners 182 coupling the clips 152, and hence the tile 30, to the framework 20 of the building, an individual tile 30 can be removed and replaced, as necessary. As previously mentioned, removal of the fasteners 182 for coupling the clips 152 to the framework 20 of the building enables removal of the tile 30, and hence the support bar 120 and clips 152 coupled thereto.

In use, in one example of a method of use, clips 152 may be coupled to the tiles 30. As previously mentioned, the clips 152 are preferably coupled to the tile 30 with an anti-rotation feature to prevent the clips 152 from rotating relative to the tile 30. If one or more support bars 120 are provided, the clips 152 may also be coupled to the support bars 120, which were previously positioned within channels 32 formed in the tile 30. First and second clips 152 can be coupled to opposite ends of each support bar 120 for coupling the first and second clips 152 to the support bar 120, and hence to the tile 30. Next, the tile 30 including the (optional) support bars 120 and clips 152 can be properly positioned relative to the framework 20 of the building 10. Thereafter, one or more fasteners 182 can be used to secure the clips 152, and hence the tile 30, to the building framework 20. Then, another tile 30 is positioned adjacent to the mounted tile 30, with the clip 152 of the tile 30 to be mounted adjacent to the already-mounted clip 152 such that the tile-mounting openings 154 of the clips 152 are aligned (e.g., with the sides 155 of the mounting clips 152 being aligned too). It will be appreciated that such method includes several independent concepts (tile system with pre-mounted clips; anti-rotation/stabilizing feature; coupling to support bar or other type of support structure; clips formed to fit with adjacent clip on adjacent tile to minimize the gap between the tiles; clips which permit readily mounting on and disassembly from building framework; clips which allow independent mounting and removal of tiles) which may be combined in any desired manner, including in combinations of just two or another number of concepts combined without necessarily including all concepts.

Referring to FIGS. 2 and 3, in one example of an embodiment, the coupling system may also incorporate an optional cable 400. In use, the cable 400 may be positioned within one or more longitudinal channels 32 formed in the tile 30. For example, the cable 400 may pass vertically through the longitudinal channel 32 so that a first end of the cable 400 can be coupled to the framework 20 of the building at a first location and a second end of the cable 400 can be coupled to the framework 20 of the building at a second location. The cable 400 may be secured to the building framework 20 via, for example, one or more fasteners 410. In use, the cable 400 helps to secure a portion of the tile 30 should it become damaged or cracked (e.g., supports the front portion of the tile 30 to prevent it from falling should it become damaged or cracked).

As previously mentioned, in use, the improved coupling system includes a plurality of coupling mechanisms (e.g., clips) for coupling a tile and, optionally a support bar, to the framework of a building. In use, as previously mentioned, the coupling mechanism (e.g., clips) may have any suitable form now known or hereafter developed. Referring to FIGS. 11-15, an alternate example of an embodiment of a coupling mechanism 550 (e.g., clip 552) for use with the coupling system 100 disclosed herein is illustrated.

As illustrated, the clips 552 may include first and second segments 560, 570 for coupling to the framework 20 of the building and tile 30, respectively. That is, in one example of an embodiment, as shown, the clip 552 may include a first segment 560 for coupling to the framework 20 of the building and a second segment 570 for coupling to the tile 30, and optionally to a support bar 120 if utilized. Thereafter, the first segment 560 may be coupled to the second segment 570 for coupling the tile 30, and optionally the support bar 120, to the framework 20 of the building.

Figure 14:
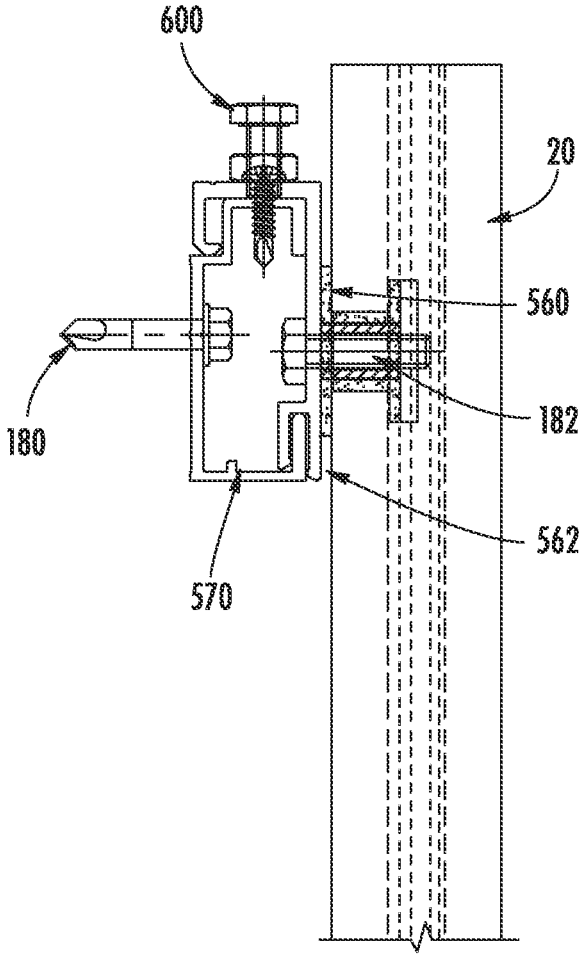
FIG. 14 is a longitudinal cross-sectional view taken along line XIV-XIV in FIG. 13.
Figure 15:
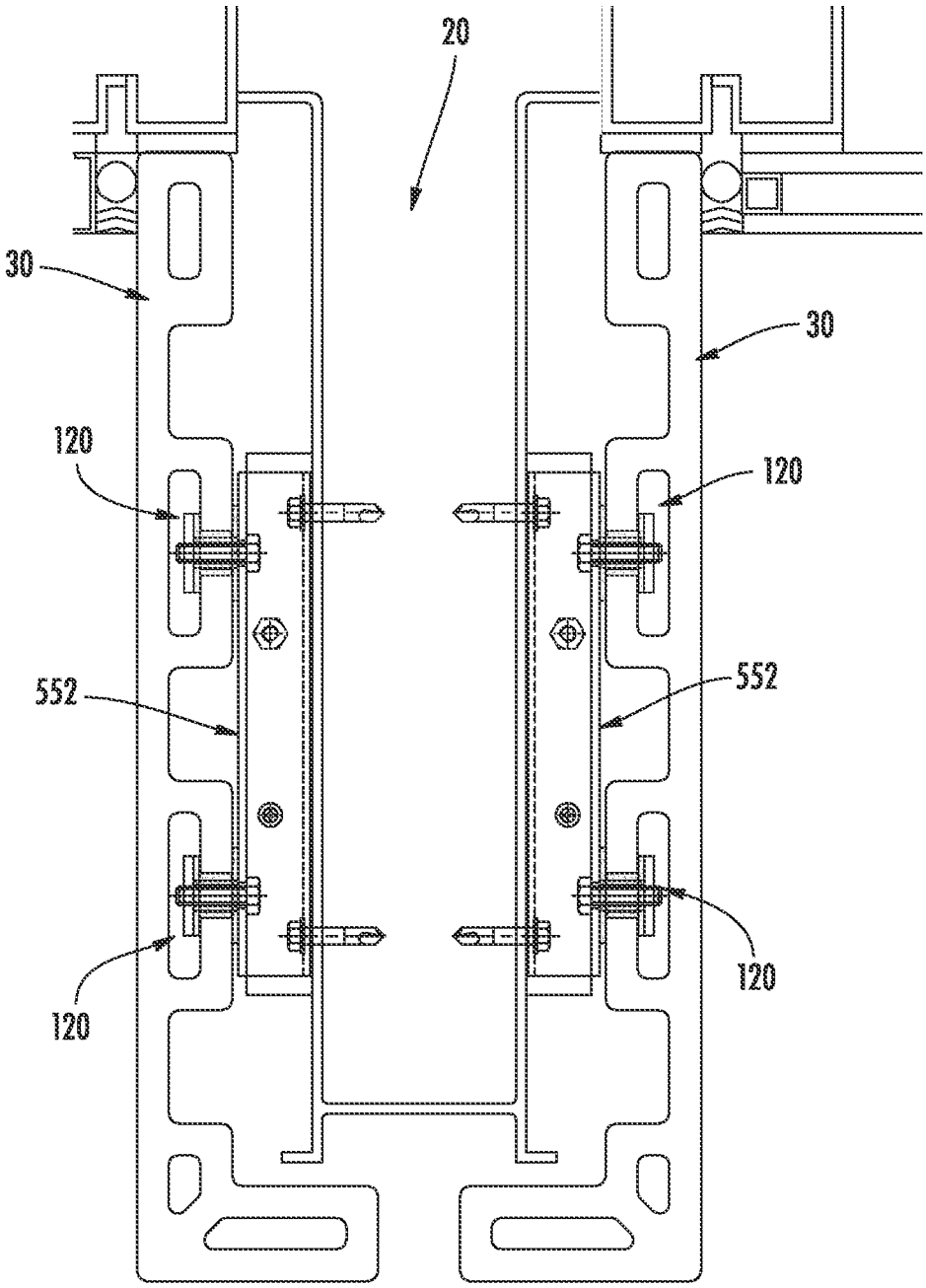
FIG. 15 is a horizontal cross-sectional view illustrating tiles coupled to a framework of a building.

The first and second segments 560, 570 may have any suitable shape. The first and second segments 560, 570 may have corresponding configurations so that the second segment 570 is arranged and configured to be received by the first segment 560, or vice-versa. For example, as shown in FIG. 14, the first segment 560 may include interlocking projections and recesses 562. In addition, at least a portion of one of the segments may be arranged and configured to be received within a cavity of the other segment. Thus arranged, the first segment 560 may be coupled to the framework 20 of the building via, for example, a fastener 182. The second segment 570 may be coupled to the tile 30, and optionally the support bar 120, via a fastener 180 passing through an opening formed in the tile 30 and into the support bar 120, as previously described. Thereafter, the second segment 570 of the clip 552 may be coupled to the first segment 560 of the clip 552 to couple the tile 30 to the framework 20 of the building.

In addition, as shown in FIG. 14, an optional fastener 600 may be incorporated to couple the first segment 560 to the second segment 570 to provide additional protection. In addition, and/or alternatively, one or more of the clip segments 560, 570 may be configured as a rail or continuous clip. That is, as shown, the first and second segments 560, 570 may be sized and configured to extend transversely across a width of the tile 30 (e.g., first and second segments 560, 570 of the clip 552 are sized to extend across multiple support bars 120 if utilized), although it is envisioned that the first and/or second segments 560, 570 may be arranged and configured as separate clips (e.g., one for each support bar 120).

While the present disclosure refers to certain embodiments, numerous modifications, alterations, and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The foregoing description has broad application. It should be appreciated that the concepts disclosed herein may apply to many types of coverings, in addition to the coverings described and depicted herein. The discussion of any embodiment is meant only to be explanatory and is not intended to suggest that the scope of the disclosure, including the claims, is limited to these embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

It should be understood that, as described herein, an "embodiment" (such as illustrated in the accompanying Figures) may refer to an illustrative representation of an environment or article or component in which a disclosed concept or feature may be provided or embodied, or to the representation of a manner in which just the concept or feature may be provided or embodied. However, such illustrated embodiments are to be understood as examples (unless otherwise stated), and other manners of embodying the described concepts or features, such as may be understood by one of ordinary skill in the art upon learning the concepts or features from the present disclosure, are within the scope of the disclosure. In addition, it will be appreciated that while the Figures may show one or more embodiments of concepts or features together in a single embodiment of an environment, article, or component incorporating such concepts or features, such concepts or features are to be understood (unless otherwise specified) as independent of and separate from one another and are shown together for the sake of convenience and without intent to limit to being present or used together. For instance, features illustrated or described as part of one embodiment can be used separately, or with another embodiment to yield a still further embodiment. Thus, it is intended that the present subject matter covers such modifications and variations as come within the scope of the appended claims and their equivalents.

As used herein, an element or step recited in the singular and proceeded with the word "a" or "an" should be understood as not excluding plural elements or steps, unless such exclusion is explicitly recited.

The phrases "at least one", "one or more", and "and/or", as used herein, are open-ended expressions that are both conjunctive and disjunctive in operation. The terms "a" (or "an"), "one or more" and "at least one" can be used interchangeably herein. Connection references (e.g., engaged, attached, coupled, connected, and joined) are to be construed broadly and may include intermediate members between a collection of elements and relative to movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative to sizes reflected in the drawings attached hereto may vary.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

The invention claimed is:

1. A system for coupling a tile to a framework of a building, said system comprising:

a tile including a first end, a second end, and one or more longitudinal channels formed in the tile extending between the first and second ends, the one or more longitudinal channels each having a longitudinal length, said tile including at least one opening formed therein; and a coupling system including:

a support bar positioned within one of said one or more longitudinal channels formed in said tile, said support bar including a first end, a second end, and a longitudinal length, the longitudinal length of the support bar extending along the longitudinal length of the tile; and at least one clip coupled to said support bar, said at least one clip including a tile-mounting opening for coupling said clip to said support bar and a frame-mounting opening for coupling said clip to the framework of the building to thereby couple the tile to the framework of the building;

wherein said tile-mounting opening of said at least one clip is configured to be aligned with one of said at least one opening formed in the tile to enable a first fastener to pass through said at least one opening formed in the tile to couple said at least one clip to said support bar.

2. The system of claim 1, wherein said at least one clip includes first and second clips coupled to said first and second ends of said support bar, respectively, each of said first and second clips including a tile-mounting opening for coupling said clip to said support bar and a frame-mounting opening for coupling said clip to the framework of the building to thereby couple the tile to the framework of the building.

3. The system of claim 2, wherein said at least one opening formed in the tile includes first and second openings formed therein, said tile-mounting opening of said first clip configured to be aligned with said first opening formed in the tile to enable said first fastener to pass through said first opening formed in the tile to couple said first clip to said first end of said support bar, said tile-mounting opening of said second clip configured to be aligned with said second opening formed in the tile to enable a second fastener to pass through said second opening formed in the tile to couple said second clip to said second end of said support bar.

4. The system of claim 2, wherein each of said first and second clips include an anti-rotation feature for engaging with a corresponding feature formed in the tile to prevent relative rotation between said first and second clips and the tile.

5. The system of claim 4, wherein said anti-rotation feature includes a projection formed on said first and second clips for engaging a groove formed in the tile.

6. The system of claim 2, wherein said frame-mounting opening of said first clip extends beyond said first end of said tile so that said frame-mounting opening of said first clip is accessible and said frame-mounting opening of said second clip extends beyond said second end of said tile so that said frame-mounting opening of said second clip is accessible.

7. The system of claim 1, further comprising at least one cable extending through one or more longitudinal channels formed in the tile, each of said cables including first and second ends for coupling said cable to the framework of the building.

8. The system of claim 1, wherein said support bar is arranged and configured for receipt within a longitudinal channel formed in the tile.

9. The system of claim 1, wherein said support bar is in the form of a flat bar extending between the first and second ends thereof.

10. A system for coupling tiles to a framework of a building, the system comprising:

a tile including a first end, a second end, and a longitudinal length as measured between the first and second ends; and a coupling system including:

a support bar arranged and configured for coupling to the tile, the support bar including a first end, a second end, and a longitudinal length, the longitudinal length of the support bar extending along the longitudinal length of the tile; and a first clip coupled to the first end of the support bar, the first clip including a tile-mounting opening for coupling the first clip to the support bar and a frame-mounting opening for coupling the first clip to the framework of the building to thereby couple the tile to the framework of the building;

wherein the frame-mounting opening of the first clip extends beyond the first end of the tile so that the frame-mounting opening of the first clip is accessible.

11. The system of claim 10, further comprising a second clip coupled to the second end of the support bar, the second clip including a tile-mounting opening for coupling the second clip to the support bar and a frame-mounting opening for coupling the second clip to the framework of the building to thereby couple the tile to the framework of the building;

wherein the frame-mounting opening of the second clip extends beyond the second end of the tile so that the frame-mounting opening of the second clip is accessible.

12. The system of claim 11, wherein the tile includes one or more longitudinal channels formed in the tile extending between the first and second ends, the one or more longitudinal channels each having a longitudinal length; and wherein the support bar is positioned within one of the one or more longitudinal channels formed in the tile.

13. The system of claim 12, wherein the tile includes first and second openings formed therein, the tile-mounting opening of the first clip configured to be aligned with the first opening formed in the tile to enable a first fastener to pass through the first opening formed in the tile and into engagement with the first opening to couple the first clip to the first end of the support bar, the tile-mounting opening of the second clip configured to be aligned with the second opening formed in the tile to enable a second fastener to pass through the second opening formed in the tile and into engagement with the second opening to couple the second clip to the second end of the support bar.

14. The system of claim 12, wherein the support bar is in the form of a flat bar extending between the first and second ends thereof.

15. The system of claim 12, further comprising at least one cable extending through one or more longitudinal channels formed in the tile, each of the cables including first and second ends for coupling the cable to the framework of the building.

16. The system of claim 10, wherein the first clip includes an anti-rotation feature for engaging with a corresponding feature formed in the tile to prevent relative rotation between the first clip and the tile.

17. The system of claim 16, wherein the anti-rotation feature includes a projection formed on the first clip for engaging a groove formed in the tile.

18. A system for coupling a tile to a framework of a building, the system comprising:

a tile including a first end, a second end, and one or more longitudinal channels formed in the tile extending between the first and second ends, the one or more longitudinal channels each having a longitudinal length; and a coupling system including:

a support bar positioned within one of the one or more longitudinal channels formed in the tile, the support bar including a first end, a second end, and a longitudinal length, the longitudinal length of the support bar extending along the longitudinal length of the tile;

at least one clip coupled to the support bar, the at least one clip including a tile-mounting opening for coupling the at least one clip to the support bar and a frame-mounting opening for coupling the at least one clip to the framework of the building to thereby couple the tile to the framework of the building; and at least one cable extending through one or more longitudinal channels formed in the tile, the at least one cable including first and second ends for coupling the at least one cable to the framework of the building.

19. The coupling system of claim 18, wherein the tile includes at least one opening formed therein; and wherein the tile-mounting opening of the at least one clip is configured to be aligned with the at least one opening formed in the tile to enable a first fastener to pass through the at least one opening formed in the tile to couple the at least one clip to the support bar.

20. The system of claim 19, wherein the at least one clip includes first and second clips coupled to the first and second ends of the support bar, respectively, each of the first and second clips including a tile-mounting opening for coupling the clip to the support bar and a frame-mounting opening for coupling the clip to the framework of the building to thereby couple the tile to the framework of the building.

21. The system of claim 20, wherein the at least one opening formed in the tile includes first and second openings formed therein, the tile-mounting opening of the first clip configured to be aligned with the first opening formed in the tile to enable the first fastener to pass through the first opening formed in the tile to couple the first clip to the first end of the support bar, the tile-mounting opening of the second clip configured to be aligned with the second opening formed in the tile to enable a second fastener to pass through the second opening formed in the tile to couple the second clip to the second end of the support bar.

22. The system of claim 21, wherein the frame-mounting opening of the first clip extends beyond the first end of the tile so that the frame-mounting opening of the first clip is accessible and the frame-mounting opening of the second clip extends beyond the second end of the tile so that the frame-mounting opening of the second clip is accessible.

23. The system of claim 18, wherein at least one of the at least one clip includes an anti-rotation feature for engaging with a corresponding feature formed in the tile to prevent relative rotation between the at least one clip and the tile.

24. The system of claim 23, wherein the anti-rotation feature includes a projection formed on the at least one clip for engaging a groove formed in the tile.

25. The system of claim 18, wherein the support bar is in the form of a flat bar extending between the first and second ends thereof.

26. A system for coupling a tile to a framework of a building, the system comprising:

a tile including a first end, a second end, and one or more longitudinal channels formed in the tile extending between the first and second ends, the one or more longitudinal channels each having a longitudinal length; and a coupling system including:

a support bar positioned within one of the one or more longitudinal channels formed in the tile, the support bar including a first end, a second end, and a longitudinal length, the longitudinal length of the support bar extending along the longitudinal length of the tile; and at least one clip including a tile-mounting opening for coupling the clip to the tile and a frame-mounting opening for coupling the clip to the framework of the building to thereby couple the tile to the framework of the building;

wherein each of the at least one clip includes an anti-rotation feature for engaging with a corresponding feature formed in the tile to prevent relative rotation between the clips and the tile.

27. The system of claim 26, wherein the anti-rotation feature is a projection formed on the at least one clip for receipt within a groove formed in the tile.

28. The system of claim 27, wherein the tile includes first and second grooves arranged and configured so that the first groove receives the projection when the clip is positioned in a first orientation and the second groove receives the projection when the clip is positioned in a second orientation.

29. The system of claim 26, wherein the tile-mounting opening formed in the at least one clip is arranged and configured to receive a fastener for coupling the clip to the support bar for coupling the clip to the tile.

30. The system of claim 26, wherein the system includes first and second tiles and first and second clips for coupling the first and second tiles to the framework of the building, each of the first and second clips including a body portion having a tile-mounting opening for coupling the clip to one of the first and second tiles, respectively, and a frame-coupling section having a frame-mounting opening for coupling the clip to the framework of the building;

wherein, when coupled to the framework of the building, the tile-mounting opening of the first clip is aligned with the tile-mounting opening of the second clip.

31. The system of claim 30, wherein, when coupled to the framework of the building, the frame-mounting opening of the first clip and the frame-mounting opening of the second clip are arranged and configured to be received side-by-side.

32. The system of claim 30, wherein each of the body portion of the first and second clips include a first width $W_1$, each of the frame-coupling sections of the first and second clips include a second width $W_2$, the width $W_2$ is less than $W_1$.

* * * * *